US006189940B1

(12) United States Patent
Hayakawa et al.

(10) Patent No.: US 6,189,940 B1
(45) **Date of Patent: *Feb. 20, 2001**

(54) DOOR LOCK ASSEMBLY FOR AUTOMOTIVE VEHICLES

(75) Inventors: Shigeru Hayakawa, Chiryu; Norikazu Kobayashi, Chita, both of (JP)

(73) Assignee: Aisin Seiki Kabushiki Kaisha, Kariya (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/236,440

(22) Filed: Jan. 25, 1999

(30) Foreign Application Priority Data

Jan. 29, 1998 (JP) ..... 10-17356

(51) Int. Cl.[7] ..... E05C 3/06
(52) U.S. Cl. ..... 292/216; 292/201; 292/DIG. 23
(58) Field of Search ..... 292/216, 201, 292/DIG. 23, DIG. 27, DIG. 62, DIG. 65, 336.3

(56) References Cited

U.S. PATENT DOCUMENTS

| | | | | |
|---|---|---|---|---|
| 4,097,077 | * | 6/1978 | Gahrs | 292/216 |
| 5,100,185 | * | 3/1992 | Menke et al. | 292/216 |
| 5,181,754 | * | 1/1993 | Shibata | 292/216 |
| 5,427,421 | * | 6/1995 | Hamaguchi | 292/216 |
| 5,531,488 | * | 7/1996 | Yoshikuwa et al. | 292/216 |
| 5,802,894 | * | 9/1998 | Jahrsetz et al. | 70/264 |
| 5,971,449 | * | 10/1999 | Rogers, Jr. et al. | 292/216 |
| 5,984,384 | * | 11/1999 | Hamaguchi et al. | 292/216 |

FOREIGN PATENT DOCUMENTS 58-31960 7/1983 (JP) .

* cited by examiner

*Primary Examiner*—Teri Pham
(74) *Attorney, Agent, or Firm*—Burns, Doane, Swecker & Mathis, LLP

(57) ABSTRACT

There is disclosed a vehicle door lock assembly performing one-motion opening function and one-step locking function with a lift lever that is not split into parts. The lock assembly has an inside lever 46 connected to an inside handle. The inside lever can engage with the lift lever 41 and with locking members 43, 47, and 52.

7 Claims, 11 Drawing Sheets

DOOR LOCK ASSEMBLY FOR AUTOMOTIVE VEHICLES

BACKGROUND OF THE INVENTION

The present invention relates to a vehicle door lock assembly and, more particularly, to a vehicle door lock assembly having one-motion opening function and one-step locking function.

In the one-motion opening function state, the door which is held in the locked state can be unlocked by manual operation of a door inside handle so that the door in the unlocked state is capable of being opened.

In the one-step locking function state, when the door is unlocked and held opened, the door can be locked and closed by manually closing the door and by manually operating a door inside locking operation member without also manually operating a door outside handle.

A conventional door lock assembly of this kind is disclosed in Japanese Utility Model Publication No. 31960/1983. This known assembly uses an opening lever that is rotated by manually operating either a door inside handle or an outside handle. This actuates a latch mechanism via a lift lever. A lock operation member is manually operated to rotate a locking member. This disengages the opening lever from the lift lever.

In this conventional assembly, the lift lever is divided into first and second lift levers. The first lift lever can engage the locking member. An inside lever can engage this first lift lever. The second lift lever is linked to the latch mechanism. The first and second lift levers can be engaged with each other in a direction to actuate the latch mechanism.

In this structure, when the locking member is in its locked position, if the inside handle is manually operated to rotate the inside lever from its initial position, the inside lever engages the first lift lever, which in turn rotates in a direction to actuate the latch mechanism. The first lift lever engages with the locking member and with the second lift lever. This rotates the locking member from its locked position to its unlocked position. The second lift lever rotates in a direction to actuate the latch mechanism, thus unlatching the latch mechanism. This is so-called one-motion opening function. When the locking member is in its locked position, if the latch mechanism is actuated, the second lift lever rotates in response to the operation of the latch mechanism. However, the rotation of the second lift lever is not transmitted to the first lift lever. Therefore, the locking member is not rotated to the unlocked position. This is so-called one-step locking function.

The aforementioned conventional assembly requires that the lift lever be split into the first and second lift levers. Therefore, this lock assembly has a large number of components and is disadvantageous in terms of the number of assembly steps and cost. Furthermore, since the lift lever is split into the first and second lift levers, some clearance must be defined between both lift levers, taking account of their dimensional errors. This clearance introduces delay to the timing at which the latch mechanism is actuated in response to operation of the inside or outside operation handle. This might deteriorate the operator's feeling in operating the assembly.

SUMMARY OF THE INVENTION

Accordingly, it is an object of the present invention to provide a door lock assembly for vehicles including an integral lift lever and having one-motion opening function and one-step locking function.

This object is achieved in accordance with the teachings of the invention by technical means in which an inside lever is linked to an inside handle and can engage with the lift lever and with a locking member.

With this technical means, when the locking member is in its locked position, if the inside handle is manually operated to rotate the inside lever from its initial position, the inside lever comes into engagement with the lift lever and with the locking member. This rotates the locking member from its locked position toward its unlocked position. Simultaneously, the lift lever rotates, actuating the latch mechanism. Thus, so-called one-motion opening function is performed. When the locking member is in its locked position, if the latch mechanism is actuated, the lift lever rotates in response to the operation of the latch mechanism. However, the rotation of the lift lever is not transmitted to the inside lever and so the locking member is not rotated into its unlocked position. So-called one-step locking function is performed. In this way, the one-motion opening function and one-step locking function are achieved with a single lift lever. Consequently, it is not necessary to split the lift lever into first and second lift levers, unlike in the prior art technique.

More preferably, the locking member has first and second arm portions. When the locking member is in its locked position, if the inside handle is manually operated to rotate the inside lever from its initial position, the first and second arm portions engage the locking member and the lift lever, respectively.

More preferably, the latch mechanism is mounted to a base plate comprising a horizontal wall and a vertical wall, which support the lift lever and the inside lever, respectively.

The locking actuator has an output lever capable of engaging the inside lever. Preferably, the locking member incorporates the output lever of the locking actuator.

Other objects and features of the invention will appear in the course of the description thereof, which follows.

DESCRIPTION OF THE PREFERRED EMBODIMENT

Figure 1:
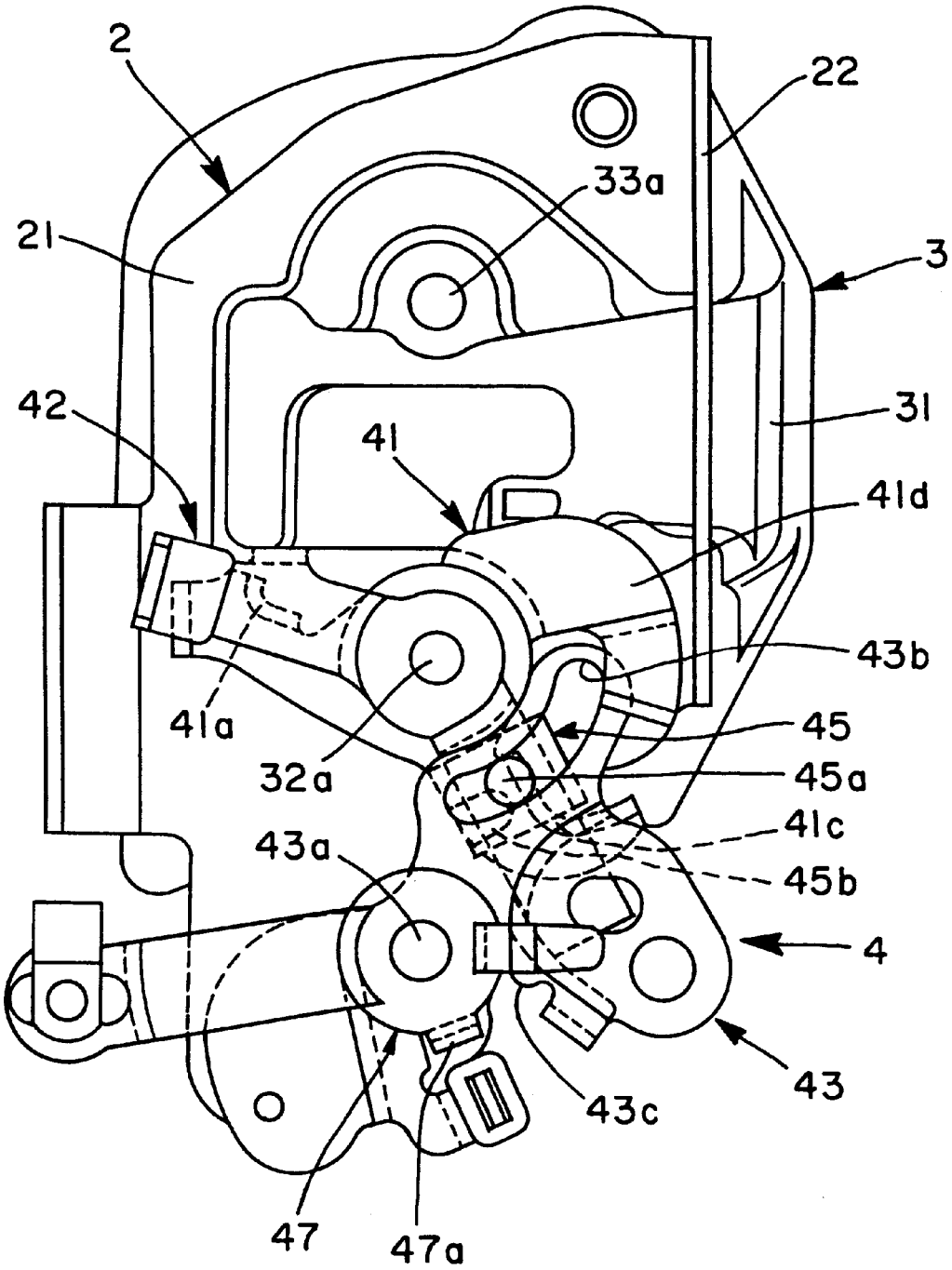
FIG. 1 a plan view of a vehicle door lock assembly in accordance with the present invention.
Figure 2:
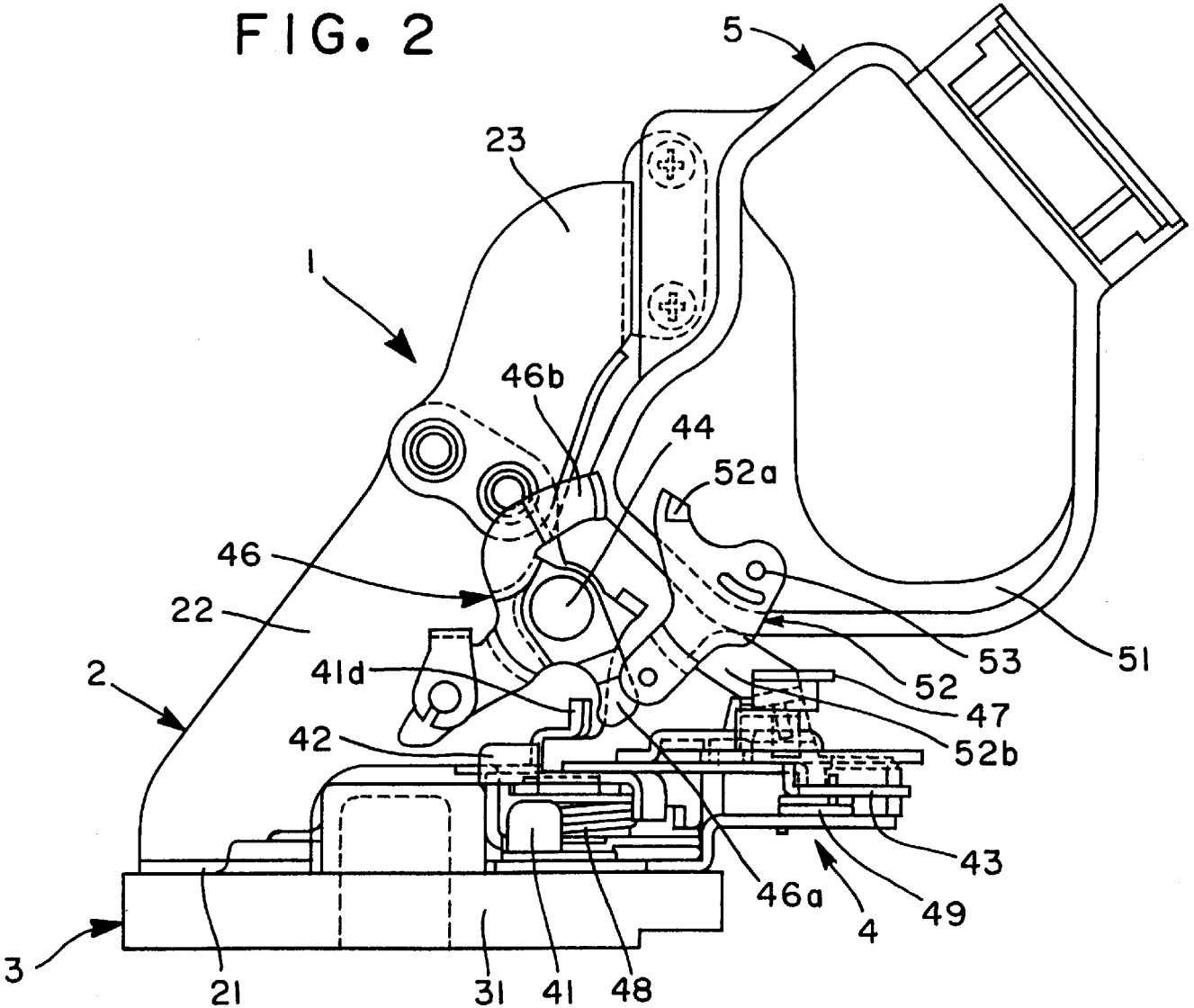
FIG. 2 is a side elevation of the vehicle door lock assembly shown in FIG. 1.

As shown in FIGS. 1 and 2, a door lock assembly, generally indicated by reference numeral 1, is built in accordance with the present invention and mounted in a vehicle door (not shown). This door lock assembly 1 comprises a base plate 2, a latch mechanism 3, a lever mechanism 4, and a locking actuator 5. The base plate 2 assumes an L-shaped form and has a horizontal wall portion 21 and a vertical wall portion 22.

Figure 4:
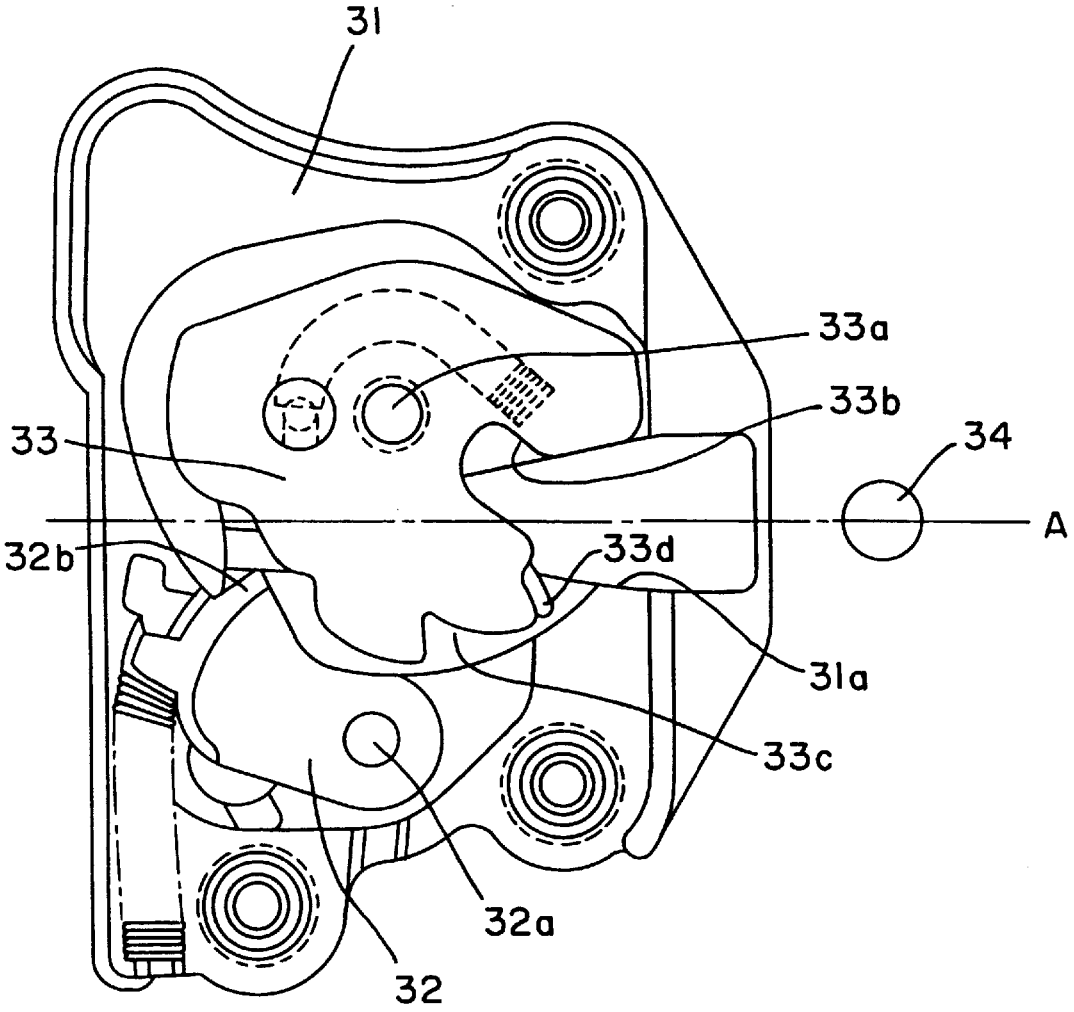
FIG. 4 is a plan view of a latch mechanism included in the door lock assembly shown in FIGS. 1 and 2.

Referring to FIG. 4, the latch mechanism 3 comprises a body 31, a pawl 32, and a latch 33. The body 31 is securely mounted to the rear surface of the horizontal wall 21 of the base plate 2 and receives the pawl 32 and the latch 33 which are biased in one direction by respective spring. A striker 34 is mounted on the vehicle body (not shown). The body 31 of the latch mechanism is provided with a groove 31*a* to permit the striker 34 to go into or out of the groove 31*a* when the door (not shown) is opened or closed. The pawl 32 and the latch 33 are rotatably held to the body 31 via pins 32*a* and 33*a*, respectively. A U-shaped groove 33*b* is formed in the outer surface of the latch 33 to receive the striker 34 when it enters the groove 31*a* in the body 31. An engaging claw 32*b* capable of engaging each grooves 33*c* and a tooth 33*d* is formed on the outer surface of the pawl 32. The pawl 32 engages one of the grooves 33*c* and the tooth 33*d* of the latch 33 when the latch 33 rotates. The pawl 32 and the latch 33 are constructed in this conventional way.

The striker 34 is received in the U-shaped groove 33*b* in the latch 33. Under this condition, the pawl 32 engages the engaging tooth 33*d* of the latch 33, whereby the pawl 32 limits rotation of the latch 33. This keeps the door closed. When the pawl 32 is rotated to disengage the pawl from the engaging tooth 33*d* of the latch 33. This permits the door to open.

Figure 3:
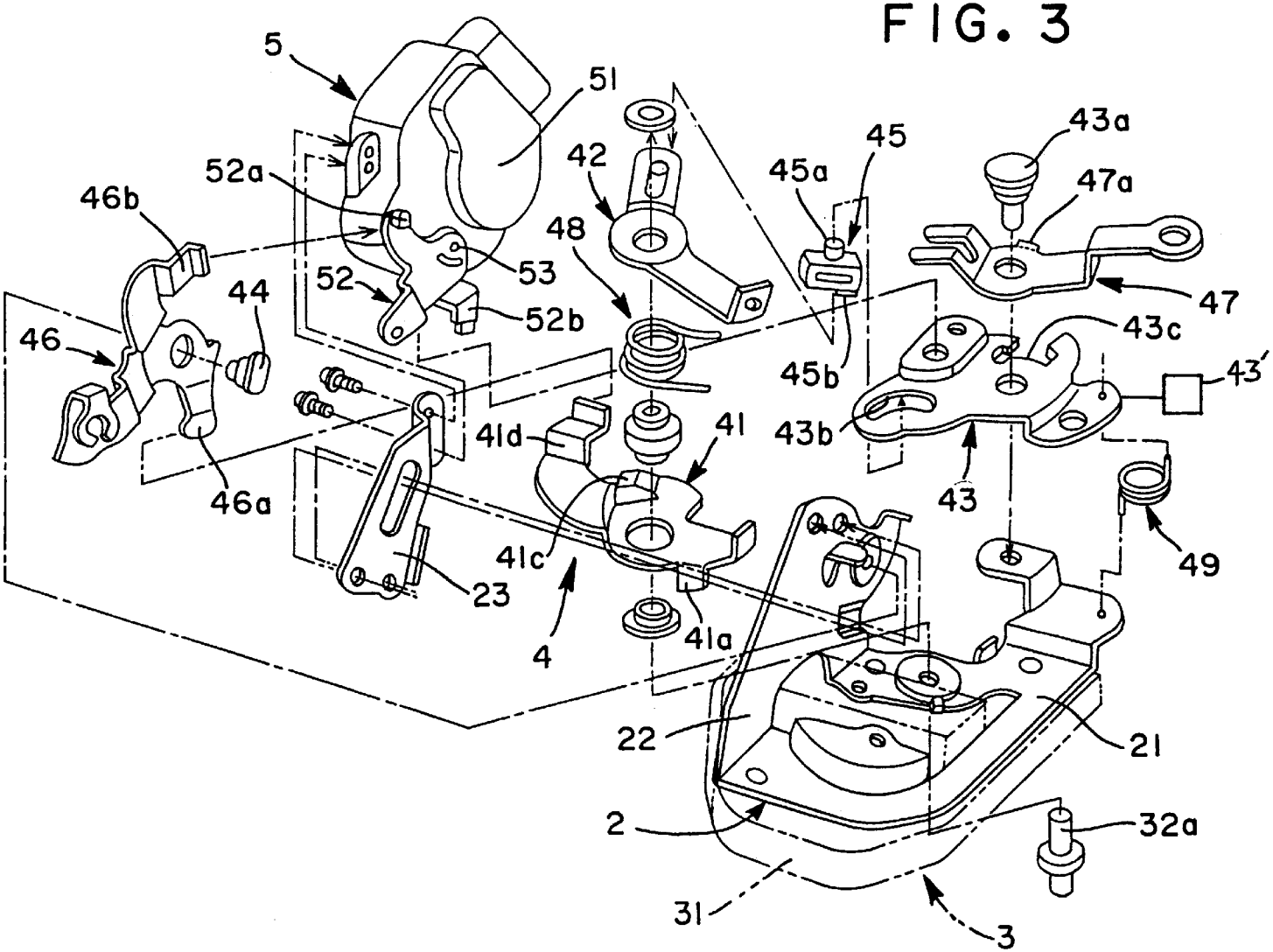
FIG. 3 is an exploded perspective view of a lever mechanism included in the door lock assembly shown in FIGS. 1 and 2.

As shown in FIGS. 1–3, the lever mechanism 4 comprises a lift lever 41, an opening lever 42, a locking lever 43, a slide bush 45, an inside lever 46, and a key lever 47. The lift lever 41 is placed on the surface of the horizontal wall 21 of the base plate 2 and rotatably held to the pin 32*a* that supports the pawl 32 of the latch mechanism 3. A fitting flange 41*a* is formed at one arm portion of the lift lever 41 and fits over the pawl 32. Thus, the lift lever 41 rotates with the pawl 32. An engaging flange 41*c* is formed at the other arm portion of the lift lever 41. A leg portion 41*d* extends from the body of the lift lever 41 and is opposite to the other arm portion.

The opening lever 42 is placed on the surface of the horizontal wall 21 and rotatably held to the pin 32*a* in the same way as the lift lever 41. This opening lever 42 has one arm portion connected via a rod (not shown) to an outside handle (not shown) mounted on the outside of the door. A spring 48 is mounted around the pin 32*a* and has its one end anchored to the opening lever 42, the other end being fixed to the base plate 2. The spring 48 always biases the opening lever 42 in a clockwise direction (as viewed in FIG. 1) toward its initial position.

The locking lever 43 is positioned on the surface of the horizontal wall 21 and rotatably held to the base portion 21 by the pin 43*a*. The locking actuator 5 has an output lever 52 (described later) to which the locking lever 43 is linked. This locking lever 43 is connected via the output lever 52 and a rod (not shown) to a locking knob (schematically shown in FIG. 3 and designated as 43') mounted on the inside of the door. Furthermore, the locking lever 43 is connected via the above-described key lever 47 to a key cylinder mechanism (not shown) mounted on the outside of the door. An arc-shaped slot 43*b* is formed about the pin 32*a* in the other arm portion of the locking lever 43.

The slide bush 45 is slidably held to the other arm portion of the opening lever 42. A pin portion 45*a* is formed on the slide bush 45 and slidably inserted in the slot 43*b* in the locking lever 43. The bush 45 has an engaging protrusion 45*b* capable of engaging with the engaging flange 41*c* of the lift lever 41 when the opening lever 42 is rotated. When the locking lever 43 is rotated, the pin portion 45*a* is inserted in the slot 43*b* and caused to slide against the other arm portion of the opening lever 42. Thus, the engaging protrusion 45*b* is brought into or out of the trajectory of the engaging flange 41*c* of the lift lever 41 in which it engages the protrusion 45*b*. As a result, the door is either locked or unlocked. A turnover spring 49 is mounted between the locking lever 43 and the base plate 2 to bias the locking lever 43 either into its locked position (FIG. 5) or into its unlocked position (FIG. 1).

The inside lever 46 is rotatablyheld to the vertical wall 22 by a pin 44. This inside lever 46 is joined via a rod (not shown) to the inside handle (not shown) mounted on the inside of the door. The aforementioned first arm portion 46*a* and second arm portion 46*b* extend from this inside lever 46.

The key lever 47 is placed on the surface of the horizontal wall 21 and rotatably held to the base portion 21 via the pin 43*a*. An engaging protrusion 47*a* is formed on this key lever 47 and received in a notch 43*c* formed in the locking lever 43. As the key lever 47 is turned, the engaging protrusion 47*a* bears against the wall portion defining the notch 43*c*, permitting the rotation of the key lever 47 to be transmitted to the locking lever 43.

Figure 6A:
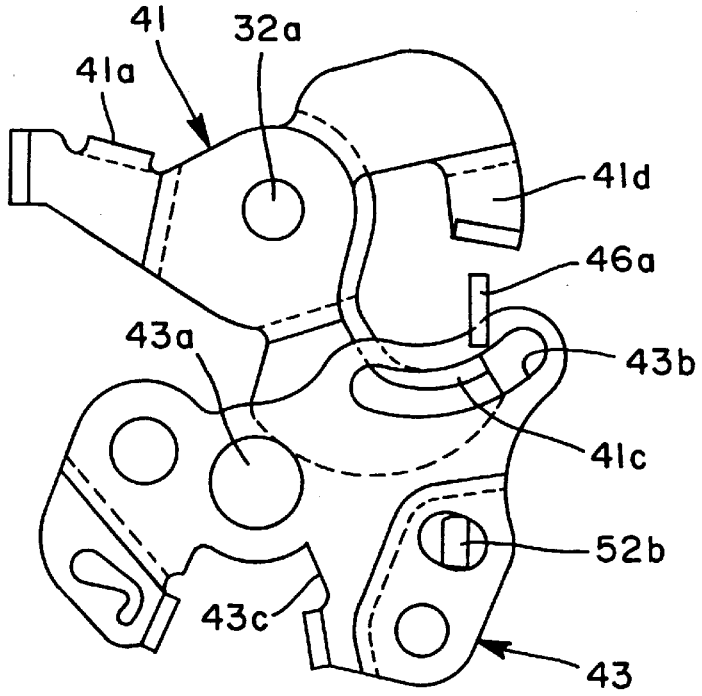
FIGS. 6*a*, 6*b*, 7*a*, 7*b*, 8*a*, 8*b*, 9*a*, and 9*b* are plan views of main portions of the vehicle door lock assembly shown in FIGS. 1 and 2, illustrating one-motion opening function using an inside lever.
Figure 6B:
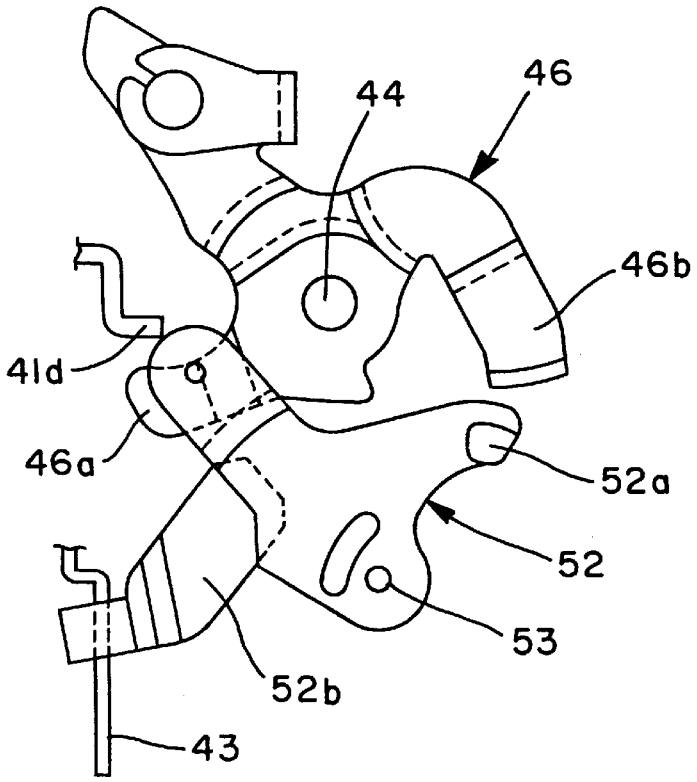
Figure 7A:
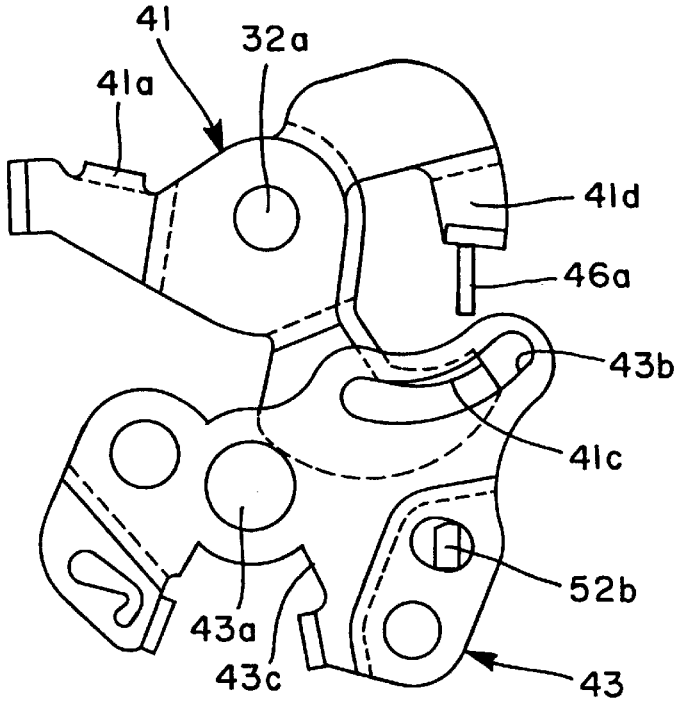
Figure 7B:
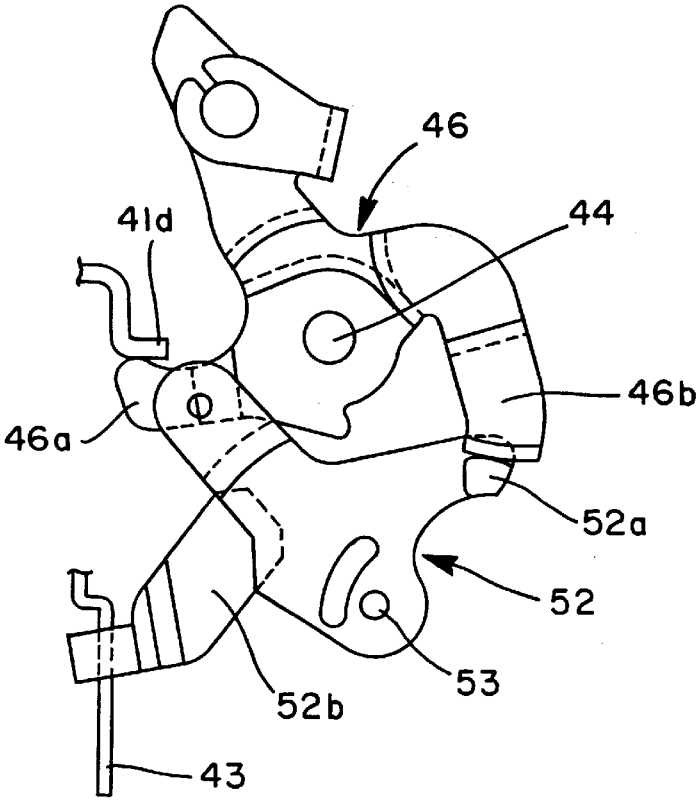
Figure 8A:
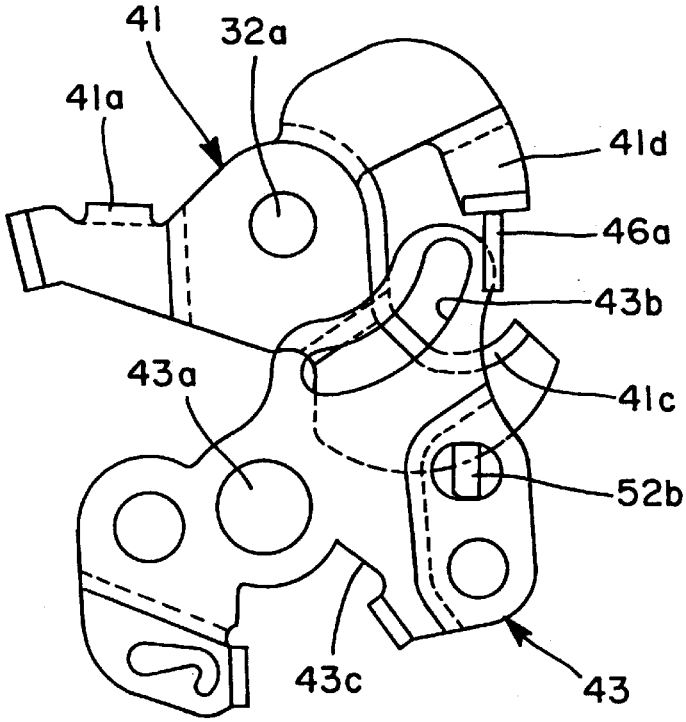
Figure 8B:
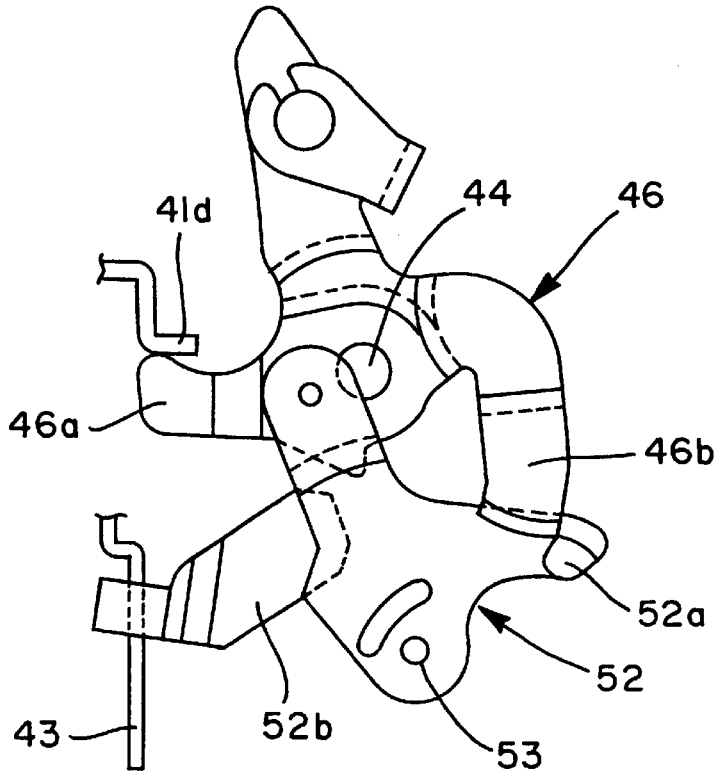
Figure 9A:
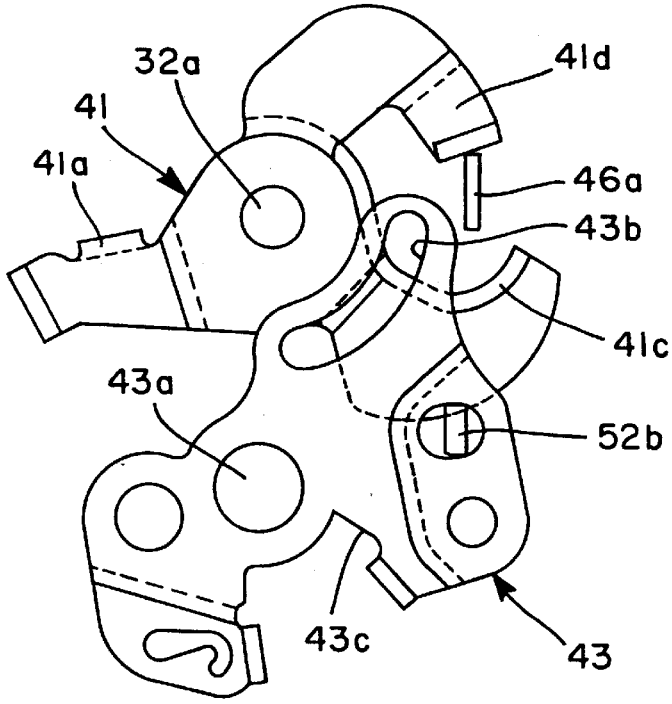

As shown in FIGS. 2 and 3, the locking actuator 5 is equipped with an electric motor (not shown) acting as a power source, the motor being contained within a housing 51. The actuator 5 is held to the vertical wall 22 of the base plate 2 via a bracket 23. The actuator 5 has an output shaft 53 extending outwardly through the housing 51. The output lever 52 is fixedly mounted to this outwardly extending portion of the output shaft 53 such that the lever 52 rotates with the output shaft 53. This output shaft 53 is coupled to the motor via a well-known reduction gearset (not shown) having a function of returning to its neutral position. The output lever 52 has a leg portion 52*b* connected to the locking lever 43 and to a locking knob (not shown) via a rod (not shown). The output lever 52 has a leg portion 52*a* extending from the body of the lever 52. In the structure of this actuator 5, the output lever 52 is rotated with the output shaft 53 by driving the motor to rotate the output shaft 53. In consequence, the locking lever 43 is rotated. The output lever 52 is biased either into its locked position (FIG. 6*a*) or into its unlocked position (FIG. 9*a*) by the turnover spring 49 in the same way as the locking lever 43.

As shown in FIG. 2, the leg portion 41*d* of the lift lever 41 is placed in the rotary trajectory of the first arm portion 46*a* of the inside lever 46 when this lever 46 is rotated from its initial position (FIG. 2) in a clockwise direction (as viewed in FIG. 2), i.e., in the direction to open the door. The first arm portion 46*a* can engage the leg portion 41*d*. When the output lever 52 is in its locked position, the leg portion 52*a* of the output lever 52 is placed in the rotary trajectory of the second arm portion 46*b* of the inside lever 46 when this lever 46 is rotated from the initial position (FIG. 2) in a clockwise direction (as viewed in FIG. 2). The second arm portion 46*b* can engage the leg portion 52*a*. When the output lever 52 is in its unlocked position, the leg portion 52*a* of the output lever 52 is off the rotary trajectory of the second leg portion 46*b* of the inside lever 46. The leg portion 52*a* is unable to engage the second leg portion 46*b*. The operation is next described.

In the state shown in FIGS. 1 and 2, the door is unlocked. The opening lever 42 and the inside lever 46 are in their initial positions. The locking lever 43 and the output lever 52 are in their unlocked positions. Under this condition, if the outside door handle is operated to rotate the opening lever 42 in a counterclockwise direction (as viewed in FIG. 1) against the biasing force of the spring 48, the engaging protrusion 45*b* of the slide bush 45 comes into engagement with the engaging flange 41*c* of the lift lever 41, thus rotating the lift lever 41 in the same direction as the opening lever 42 (i.e., in the direction to open the door) The pawl 32 is rotated, permitting the door to be opened. If the inside handle is operated to rotate the inside lever 46 in a clockwise direction (as viewed in FIG. 2) (i.e., in the direction to open the door), the first arm portion 46*a* engages and pushes the leg portion 41*d*, rotating the lift lever 41 in a counterclockwise direction (as viewed in FIG. 1) (i.e., in the direction to open the door). Consequently, the pawl 32 is rotated, permitting the closed door to be opened.

Figure 5:
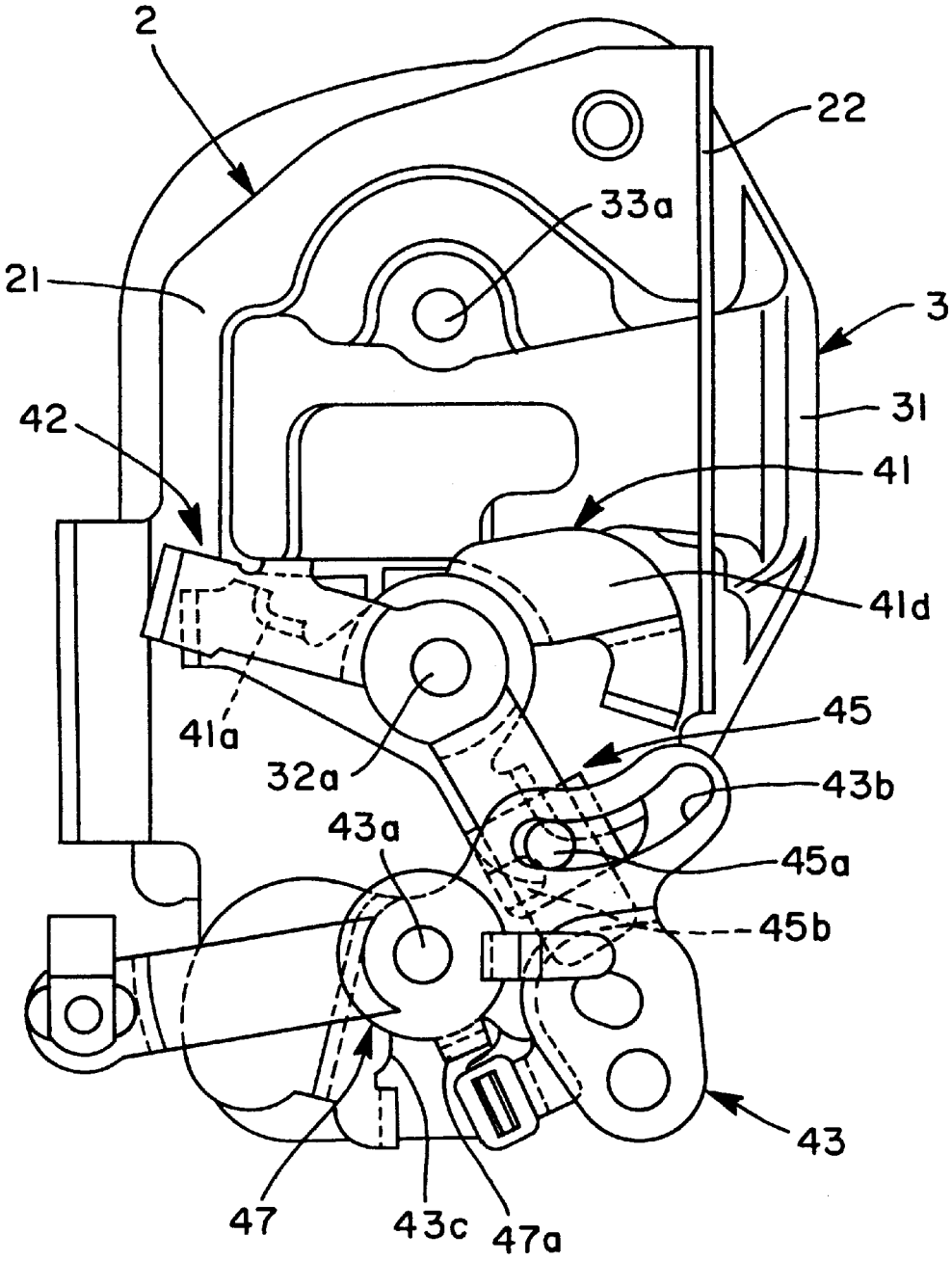
FIG. 5 is plan view similar to FIG. 1, but in which the door is locked.

Referring to FIG. 1, if the locking knob, the key cylinder mechanism, or the actuator 5 is operated to rotate the locking lever 43 in a clockwise direction (as viewed in FIG. 1), and if the locking lever 43 is brought into its locked position, the slide bush 45 slides against the opening lever 42 as shown in FIG. 5. This brings the engaging protrusion 45*b* of the slide bush 45 out of the rotary trajectory in which the protrusion 45*b* engages the flange 41*c* of the lift lever 41 when the opening lever 42 is rotated. The result is that the opening lever 42 and the lift lever 41 rotate idly. Hence, the door, being unlocked, is now locked. At this time, the output lever 52 is also put into its locked position.

Figure 9B:
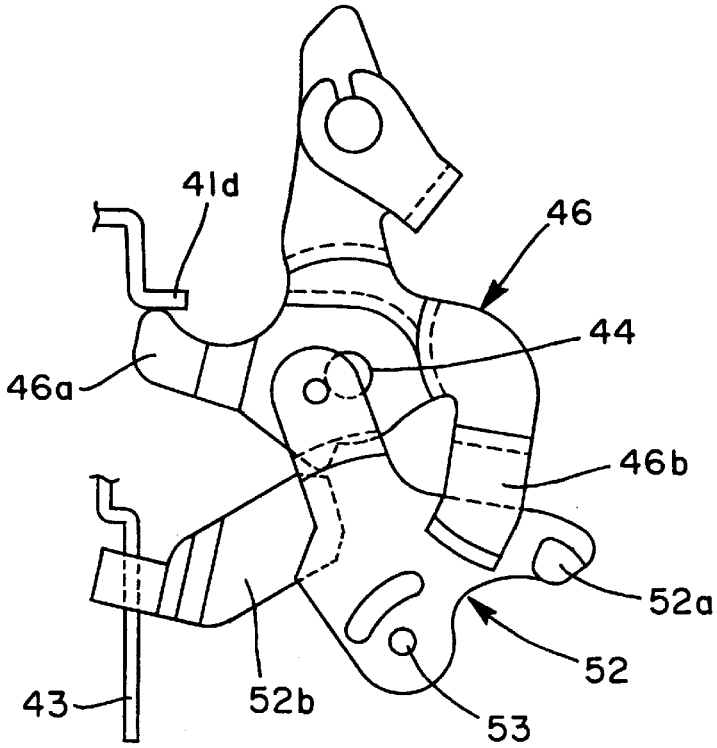
Figure 10A:
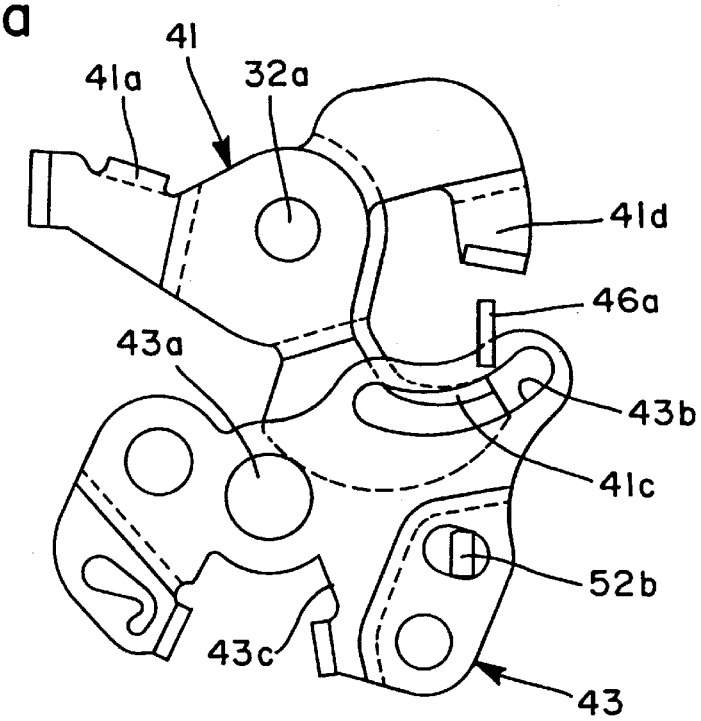
FIGS. 10*a*, 10*b*, 11*a*, and 11*b* are plan views of main portions of the vehicle door lock assembly shown in FIGS. 1 and 2, illustrating one-step locking function.
Figure 10B:
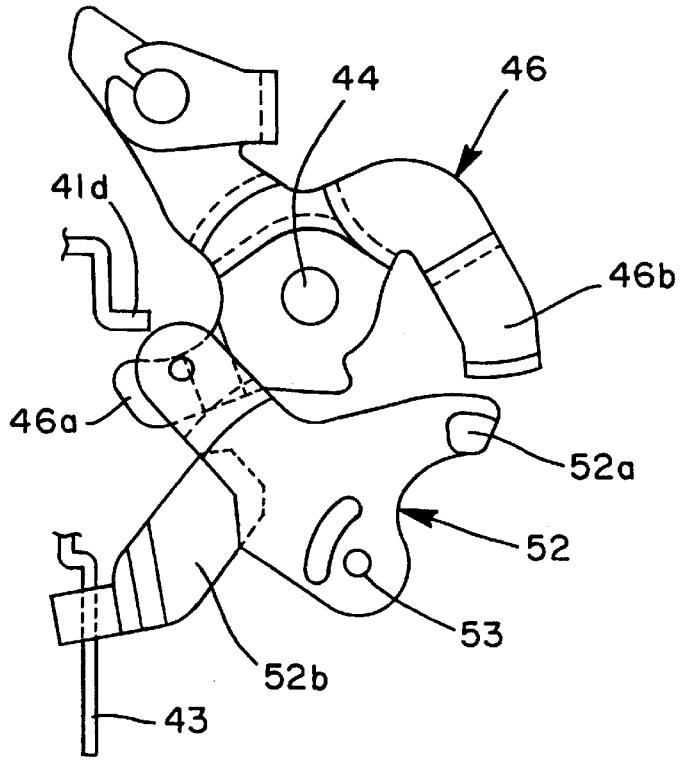
Figure 11A:
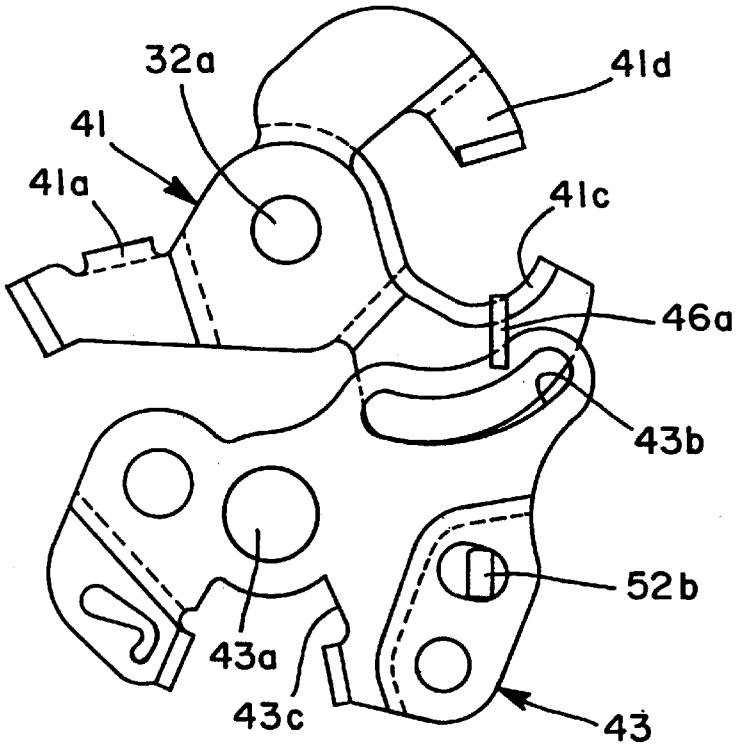
Figure 11B:
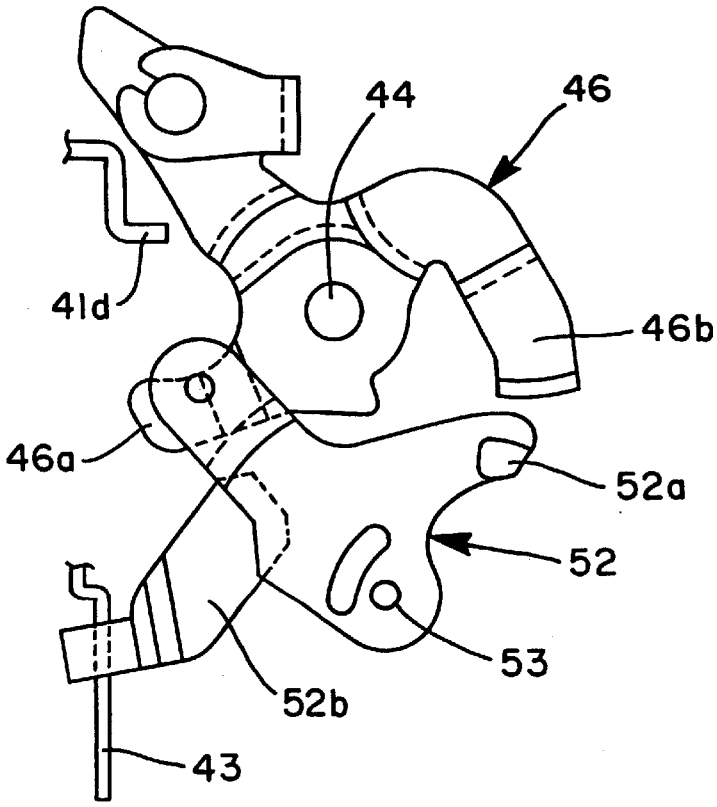

In FIG. 5, if the inside handle is operated to rotate the inside lever 46 in the direction to open the door, the first arm portion 46*a* engages and pushes the leg portion 41*d*, as shown in FIGS. 6*a*–9*b* to rotate the lift lever 41 in the direction to open the door. At the same time, the second leg portion 46*b* engages and pushes the leg portion 52*a*, rotating the output lever 52 in the direction of unlocking operation into its unlocked position. The locking lever 43 is moved into its unlocked position. The door, being locked and open, is unlocked and allowed to be opened. Thus, so-called one-motion opening function is performed. The leg portion 52*a* of the output lever 52 in its unlocked position is taken out of the rotary trajectory of the second arm portion 46*b* when the inside lever 46 is rotated, as shown in FIG. 9*b*. Therefore, the operation of the inside lever 46 is not hindered at all when the door is unlocked.

Where the passenger locks the door in leaving the vehicle, if he or she operates the locking knob to lock the door and then closes the door (so-called keyless locking), the latch mechanism 3 interlocks with the operation for closing the door and rotates the lift lever 41 in the direction to open the door, in the same way as when the inside handle or the outside handle is operated, as shown in FIGS. 10*a* and 11*a*. However, the rotation of the lift lever 41 in the direction to open the door moves the leg portion 41*d* of the lift lever 41 away from the first arm portion 46*a* of the inside lever 46. Therefore, as shown in FIGS. 10*b* and 11*b*, the inside lever 46 is not rotated in the direction to open the door. Consequently, the output lever 52 in its locked position is not rotated to its locked position in spite of the engagement of the second leg portion 46*b* of the inside lever 46 with the leg portion 52*a*. Rather, it is assured that the output lever 52 is held in its locked position. In this way, when the keyless locking is done, it is not necessary to operate the outside handle. That is, so-called one-step locking function is fulfilled.

In the embodiment described above, the output lever 52 of the locking actuator 5 is a locking member set forth in claim 1. Where the locking actuator 5 is not present, the lever may be rotatably held to the vertical wall 22 of the base plate 2, and this lever may be used as the locking member set forth in claim 1 instead of the output lever 52.

In accordance with the present invention, an inside lever capable of engaging with a lift lever is permitted to engage a locking member. The lift lever is an integral component; in the past, the lift lever has been split into first and second lift levers. Consequently, one-motion opening function and one-step locking function can be accomplished without increasing the number of components.

As many apparently widely different embodiments of the present invention can be made without departing from the spirit and scope thereof, it is to be understood that the invention is not limited to the specific embodiments thereof except as defined in the appended claims.

What is claimed is:

1. A vehicle door lock assembly for automotive vehicles, comprising:

an inside lever adapted to be mounted in the inside of a door and adapted to be connected to an inside handle, said inside lever being capable of being rotated from an initial position by manually operating said inside handle;

an opening lever adapted to be connected to an outside handle mounted on the outside of the door and capable of being rotated by manually operating the outside handle;

a latch mechanism actuated by said inside lever or said opening lever via a lift lever capable of engaging with said inside lever;

a locking lever connected to said opening lever via a slide bush; and locking means having a leg portion positioned along a rotary path of said inside lever at a locked position of said locking lever, said inside lever being adapted to engage said lift lever and said leg portion of said locking means to operate said latch mechanism and said slide bush when said inside lever is rotated from said initial position through a single operation of the inside handle.

2. The vehicle door lock assembly of claim 1, wherein said inside lever has a first arm portion and a second arm portion, and wherein, when said inside handle is manually operated to rotate said locking means from their initial locked position, said first arm portion and said second arm portion engage said locking means and said lift lever, respectively.

3. The vehicle door lock assembly of claim 1, wherein said latch mechanism is mounted to a base plate having a horizontal wall portion and a vertical wall portion, and wherein said horizontal wall and said vertical wall hold said lift lever and said inside lever, respectively.

4. The vehicle door lock assembly of claim 1, wherein a locking actuator has an output lever capable of engaging said locking means.

5. A vehicle door lock assembly for vehicles having a structure for actuating a latch mechanism by rotational operation of either an inside lever or an opening lever via a lift lever and engaging or disengaging said opening lever and said lift lever by rotating a locking member connected to a locking operation knob, said inside lever being adapted to be connected to an inside handle, said inside lever directly engaging said lift lever and said locking member to rotate said locking member and said lift lever, said inside lever directly engaging the locking member to rotate the locking member when the locking member is in a locked position and directly engaging the lift lever to actuate the latch mechanism upon operation of the inside lever from an initial position during a single operation of the inside handle.

6. The vehicle door lock assembly of claim 5, wherein said locking member is connected to a locking lever which is connected to said opening lever via a slide bush.

7. The vehicle door lock assembly of claim 6, wherein said locking member is secured to an output shaft of an electrical actuator.

* * * * *